US005328093A

United States Patent [19]

Feitel

[11] Patent Number: 5,328,093

[45] Date of Patent: Jul. 12, 1994

[54] WATER-BASED PLURAL COMPONENT SPRAY PAINTING SYSTEM

[75] Inventor: Ann Feitel, St. Louis Park, Minn.

[73] Assignee: Graco Inc., Golden Valley, Minn.

[21] Appl. No.: 98,801

[22] Filed: Jul. 28, 1993

[51] Int. Cl.[5] ..... B05B 5/16

[52] U.S. Cl. ..... 239/3; 239/61; 239/68; 239/69; 239/75; 239/304; 239/691; 239/708; 239/690

[58] Field of Search ..... 239/3, 690, 704, 705, 239/706, 707, 708, 61, 68, 69, 75, 304; 118/621, 627, 629

[56] References Cited

U.S. PATENT DOCUMENTS

| | | | |
|---|---|---|---|
| 3,929,286 | 12/1975 | Hastings et al. | 239/3 |
| 4,002,777 | 1/1977 | Juvinall et al. . | |
| 4,265,858 | 5/1981 | Crum et al. . | |
| 4,278,205 | 7/1981 | Binoche | 239/75 |
| 4,650,003 | 3/1987 | Euson . | |
| 4,792,092 | 12/1988 | Elberson et al. . | |
| 4,878,454 | 11/1989 | Cann . | |
| 4,881,688 | 11/1989 | Hankvist et al. | 239/691 |
| 4,884,752 | 12/1989 | Plummer . | |
| 4,932,589 | 6/1990 | Diana . | |
| 4,962,724 | 10/1990 | Prus et al. . | |
| 4,982,903 | 1/1991 | Jamison et al. . | |
| 4,995,560 | 2/1991 | Lasley et al. . | |
| 5,014,645 | 5/1991 | Cann et al. . | |
| 5,058,805 | 10/1991 | Anderson et al. | 239/3 |
| 5,058,812 | 10/1991 | Cox et al. . | |

FOREIGN PATENT DOCUMENTS

| | | | |
|---|---|---|---|
| 1061847 | 12/1983 | U.S.S.R. | 239/690 |

*Primary Examiner*—Andres Kashnikow
*Assistant Examiner*—William Grant
*Attorney, Agent, or Firm*—Palmatier, Sjoquist & Helget

[57] ABSTRACT

The invention includes an electrically isolated electrically less-conductive component fluid-flow course and an electrically-grounded electrically more-conductive component fluid-flow course. The electrically more-conductive component fluid-flow course may be additionally electrically isolated at the preference of an operator. The invention includes an electrostatic spray gun a mixer positioned proximal to the electrostatic spray gun, and a first conduit which holds alternating segments of electrically more-conductive component and electrically less-conductive component. The alternating segments function in series to additively provide a combined resistance which electrically blocks the high-voltage potential generated at the electrostatic spray gun. This, in turn, effectively isolates the electrically more-conductive component fluid-flow course and electrically less-conductive fluid-flow course from the high-voltage potentials, which significantly improves the safety of an electrostatic spray gun used with water-based paints, while simultaneously permitting the use of a standard color change system.

59 Claims, 2 Drawing Sheets

WATER-BASED PLURAL COMPONENT SPRAY PAINTING SYSTEM

BACKGROUND OF THE INVENTION

This invention relates to electrostatically-aided atomization and dispensing systems for water-based coating materials and more particularly to systems which are able to mix and dispense both electrically more-conductive coating materials such as water or water-based coating materials, and electrically less-conductive coating materials such as organic solvent and resin-based coating materials. A problem exists when electrostatically-aided atomization and dispensing processes are used to dispense highly conductive coating materials. That problem is isolation of the electrostatic high-potential source from ground.

When applying paint with a hand-held electrostatic spray gun, it is desirable to electrically ground the spray gun body to protect the operator from risk of electrical shock. It is also desirable to electrically ground the paint supply, water supply, and/or solvent resin supply to prevent current from flowing from the paint-charging electrode at the spray gun tip through the paint column to electrically charge the entire paint or water supply. If the paint or water supply is isolated from ground and becomes charged, the operator is at risk of receiving a potentially hazardous shock from the paint or water source as it is replenished or otherwise serviced. It is desirable to protect an operator from electrical shock when the entire paint or water column from the source to the electrostatic spray gun is grounded which minimizes danger of accidents resulting from the rupture, cut or a pin-hole break in the paint supply hose allowing a spark from the paint column to ground. If the paint column were charged and a spark should occur, there is a risk that flammable paint solvents could ignite or explode.

The invention concerns a method for spray coating a product, notably an electrically-conductive coating product such as a water-soluble paint applied electrostatically, and is more particularly concerned with a new arrangement for changing such products rapidly. The invention is more particularly directed to solving the additional problems which arise in this context from electrostatic application of watersoluble paints having a relatively high electric conductivity.

In known conventional installations, the coating-product circuits, compressed-air circuits, and cleaning-product circuits are connected via isolation valves to a manifold having a common outlet branch connected to the electrostatic spray gun. This arrangement will be referred to hereinafter as a "coating-product change unit" or, more simply, a "color change unit." Conventionally, to change color the valve on the circuit of the coating product in use must be closed a particular "computed" time before the end of the current spraying phase and then the compressed air valve opens to propel the remaining product toward the sprayer. The cleaning cycles are then carried out compressing a succession of injections of cleaning product and compressed air until the pipes are clean and dry. Finally, the valve on another coating-product circuit is opened to fill the manifold and the pipes until a little of the new color-coating product exists in the sprayer. A new paint-spraying phase may then begin.

SUMMARY OF THE INVENTION

The invention relates to a grounded or isolated water-based plural component system for the electrostatic application of water-based paint. The invention enables the use of traditional color change systems during use of electrostatic spray devices. The invention includes an electrically-isolated, electrically less-conductive component fluid-flow course and an electrically grounded, electrically more-conductive component fluid-flow course. The electrically more-conductive component fluid-flow course may be additionally electrically isolated at the preference of an operator. The invention includes an electrostatic spray gun device, a mixing means positioned proximal to the electrostatic spray gun, and a first conduit which holds alternating segments of electrically more-conductive component and electrically less-conductive component. The alternating segments of electrically less-conductive component and electrically more-conductive component function in series to additively provide a combined resistance which electrically blocks the high-voltage potential generated at the tip of the electrostatic spray gun. This, in turn, effectively isolates the electrically more-conductive component fluid-flow course and electrically less-conductive fluid-flow course from the high-voltage potentials, which significantly improves the safety of an electrostatic spray gun used with water-based paints, while simultaneously permitting the use of standard color change systems.

It is an object of the present invention to provide either an isolated or grounded water-based plural component system in order to enable the use of a traditional color change system when spraying water-based paint materials with an electrostatic water-based paint spraying device.

It is another object of the present invention to provide a new and improved isolated or grounded water-based plural component system of relatively simple and inexpensive design, construction, and operation, which is safe and which fulfills the intended purpose of reducing, if not eliminating, risks of injury to persons and/or property while simultaneously permitting the use of traditional color change systems during the electrostatic application of water-based paints.

It is still another object of the present invention to electrically isolate an electrically less-conductive component fluid-flow course from exposure to high-voltage electrical potentials generated proximal to the tip of an electrostatic spray gun device.

It is still another object of the present invention to electrically ground and/or electrically isolate and ground an electrically more-conductive component fluid-flow course from the high-voltage electrical potentials generated proximal to the tip of an electrostatic spray gun device.

A feature of the present invention includes a means for mixing an electrically more-conductive component to an electrically less-conductive component proximal to an electrostatic spray gun of an electrostatic water-based paint spraying device.

Another feature of the present invention includes a first conduit for confining alternating segments of electrically more-conductive component and electrically less-conductive component where the alternating segments function as a series of resistors causing a voltage gradient and/or voltage potential drop to approximately zero at the storage facilities for the electrically less-conductive component and the electrically more-conductive component.

Still another feature of the present invention includes a means for alternating the electrically more-conductive component and the electrically less-conductive component which is engaged to the first conduit where the alternating segments of electrically less-conductive component functions as a series of resistors providing a combined resistance for minimization of electrical potentials within the electrostatic water-based paint spraying system.

Still another feature of the present invention includes a second conduit for confining an electrically less-conductive component between a first storage facility and the means for alternating.

Still another feature of the present invention includes a third conduit for confining the electrically more-conductive component between a second storage facility and the means for alternating.

Still another feature of the present invention includes a means for control and a means for regulating the flow of electrically more-conductive component and the electrically less-conductive component to the means for alternating.

Still another feature of the present invention includes an electrically grounded first storage facility for holding the electrically less-conductive component which is effectively electrically isolated from the electrostatic spray gun of an electrostatic water-based paint spraying system.

Still another feature of the present invention includes a traditional color change system connected in fluid-flow relationship to the first storage facility.

Still another feature of the present invention includes an electrically-grounded and/or an electrically-grounded and isolated second storage facility for holding the electrically more-conductive component which is electrically separated from the second conduit and the first storage facility.

Still another feature of the present invention includes a second storage facility which may be supported and isolated from ground by an isolation stand, where the second storage facility includes a bleed resistance element incorporated into the electrical-ground element.

DETAILED SPECIFICATION OF THE PREFERRED EMBODIMENT

Figures 1, 3:
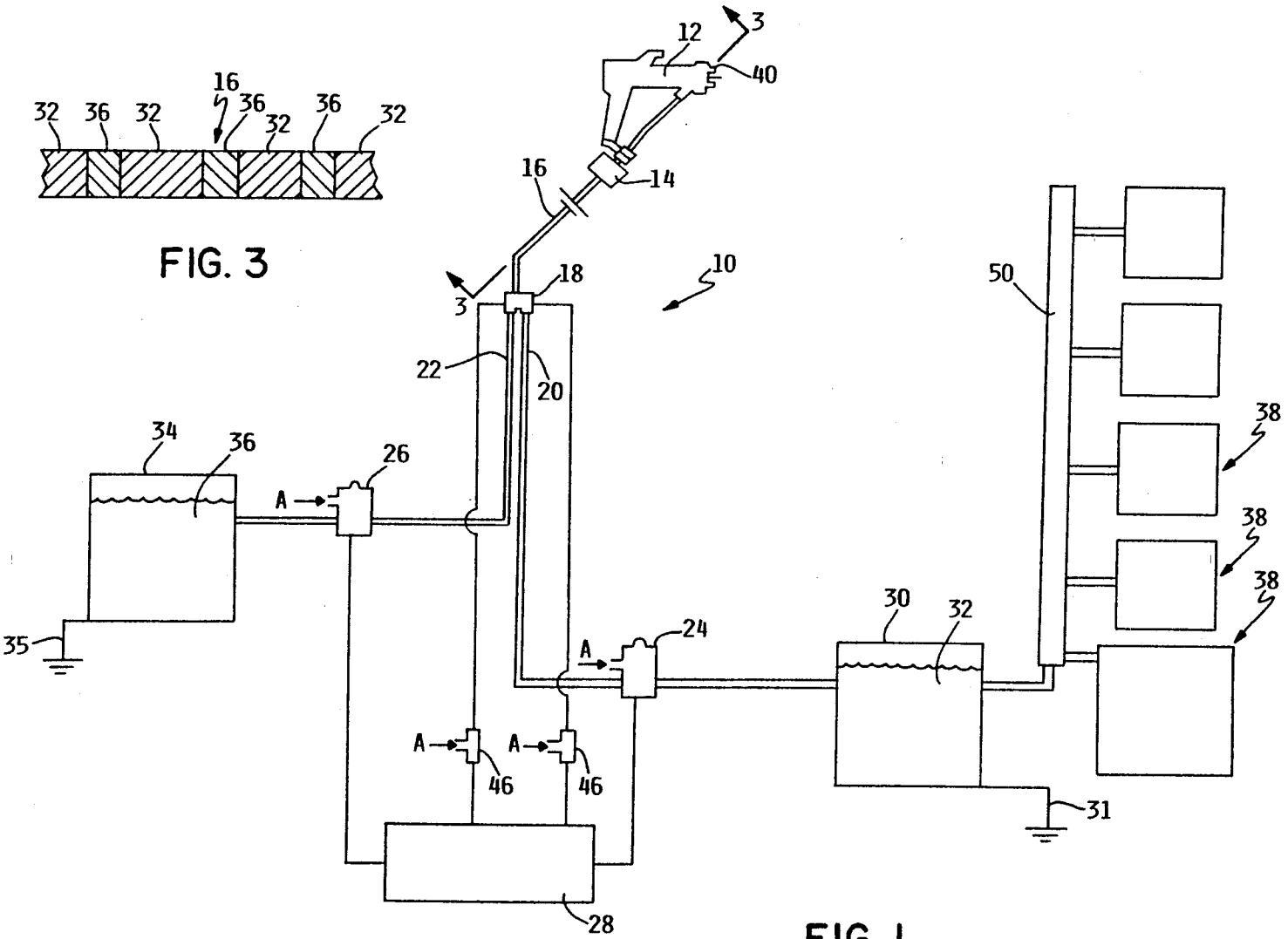
FIG. 1 is a schematic block diagram of the invention.
FIG. 3 is a detail cross sectional view of the first conduit taken along the line of 3—3 of FIG. 1.

One form of the invention is illustrated and described herein. The water-based plural component system is indicated in general by the numeral 10. The water-based plural component system 10 includes an electrostatic spray gun 12, a means for mixing 14, a first conduit 16, a means for alternating 18, a second conduit 20, a third conduit 22, a first means for regulating 24, a second means for regulating 26, a means for control 28, a first storage facility 30 having an electrical connection to ground 31 holding an electrically less-conductive component 32, a second storage facility 34 having an electrical connection to ground 35 holding an electrically more-conductive component 36, and a color change system 38.

In general, the elements of the water-based plural component system 10 are connected in the following relationship; the means for mixing 14 is connected proximal, and in fluid-flow relationship to, the electrostatic spray gun 12. The first conduit 16 is connected in fluid-flow relationship to, and depends from, the means for mixing 14. The means for alternating 18 is connected in fluid-flow relationship to the first conduit 16 opposite to the means for mixing 14, defining the length of the first conduit 16. The second conduit 20 is connected in fluid-flow relationship to, and depends from, the means for alternating 18. The second conduit 20 is further connected in fluid-flow relationship to the first storage facility 30. The color change system 38 is also connected in fluid-flow relationship to the first storage facility 30. The first means for regulating 24 is connected in fluid-flow relationship to the second conduit 20 between the means for alternating 18 and the first storage facility 30. The third conduit 22 is connected in fluid-flow relationship to, and depends from, the means for alternating 18. The third conduit 22 is further connected in fluid-flow relationship to the second storage facility 34. The second means for regulating 26 is connected in fluid-flow relationship to the third conduit 22 between the means for alternating 18 and the second storage facility 34. The means for control 28 is electrically and/or optically connected to the first means for regulating 24 for controlling the flow rate of electrically less-conductive component 32 within the second conduit 20. The means for control 28 is also electrically and/or optically connected to the second means for regulating 26 for controlling the flow rate of electrically more-conductive component 36 within the third conduit 22. The means for alternating 18 alternately regulates the passage of the electrically less-conductive component 32, and the electrically more-conductive component 36 within the first conduit 16 (FIG. 3). The means for mixing 14 preferably mixes the alternating portions of electrically less-conductive component 32 and the electrically more-conductive component 36 into a homogeneous water-based paint for electrostatic ejection from the tip 40 of the electrostatic spray gun 12.

The electrostatic spray gun 12 is preferably electrically connected to an adjustable and/or interruptible high-tension voltage supply (not shown). The electrostatic spray gun 12 preferably ejects a desired atomized pattern of a homogeneous mixture of water-based paint for application and coating of manufactured articles. Frequently, following the completion of the painting of an article, the color of the water-based plural component system 10 is changed necessitating the use of solvents for the flushing and removal of the undesirable color from the system. It should be noted that during a cleaning cycle that the supply of electrical high-potential voltage to the tip 40 of the electrostatic spray gun 12 is terminated in order to eliminate the risk of ignition of potentially flammable and explosive cleaning solvents. It should also be noted that the electrostatic spray gun 12 is commonly powered by compressed air directed through a turbine type of motor (not shown).

The preferred electrostatic spray gun 12 used in the water-based plural component system 10 is identified as part number 222-700, model PRO 3500WB, as manufactured by Graco Inc. of Minneapolis, Minn. The electrostatic spray gun 12 is preferably used in conjunction with an electrostatic air spray system when spraying conductive, water-based fluids having flash points above 140° F. (60° C.) and having a maximum 20%, by weight, organic solvent concentration. The electrostatic spray gun 12 may be of any conventional design and typically will include a body, a handle, a barrel, and a tip 40. Together, the barrel and the tip 40 form an assembly for receiving and atomizing paint or other materials to be sprayed. A paint-charging electrode may project from the tip 40 or may be confined within the tip 40 for imparting an electrostatic charge to the atomized paint. For operator safety, the handle, and preferably also the body, are formed from an electrically-conductive material, such as conductive plastic or metal, and are electrically grounded. If the electrostatic spray gun 12 requires compressed air for atomization of the paint and/or for shaping the pattern of the paint spray, compressed air is supplied from a suitable external source attached to a connector on the electrostatic spray gun handle 12. Electrical power is applied to the electrostatic spray gun 12 from a suitable remote source connected through a wire to a connector on the handle. The electrical connection to the connector also electrically grounds the electrostatic spray gun 12 and all attached electrically-conductive components.

The means for mixing 14 is preferably positioned proximal to the electrostatic spray gun 12 in fluid-flow relation thereto. In the preferred embodiment, the means for mixing 14 is a static mixing tube which is constructed similar to part number 513-051 inside of a tube constructed similar to 513-050 as manufactured by Graco Inc. of Minneapolis, Minn. In the preferred embodiment, the static mixing tube would include a straight length of tubing. Alternatively, the means for mixing 14 may be a pre-orifice for operation in conjunction with the tip 40 of an electrostatic spray gun 12. The means for mixing 14 preferably mixes the electrically lessconductive component 32 and the electrically more-conductive component 36 into a homogeneous mixture for atomized ejection from the tip 40 during coating of manufactured articles during use of the water-based plural component system 10.

In the preferred embodiment, the means for mixing 14 mixes alternating portions of electrically more-conductive component 36 which is preferably formed of water, to portions of electrically less-conductive component 32 which are preferably formed of a solvent and resin mixture. In an alternative embodiment, the electrically more-conductive component 36 is formed of water-based paint and the electrically less-conductive component 32 is formed of air. The means for mixing 14 is not electrically separated or isolated from the high voltage electrical potentials generated at the tip 40 of the electrostatic spray gun 12. Therefore, if alternate means for mixing 14 are to be used, the components for the means for mixing 14 are required to function in conjunction with, or during exposure to, high-voltage electrical potentials. An electrical mixing apparatus may therefore not be a desirable means for mixing 14. Alternatively, a mechanically powered means for mixing 14 may be appropriate, especially if powered by compressed air. It is expected that the means for mixing 14 operates, and is able to withstand, without fail, exposure to high-voltage electrical potentials which may be on the order of 60 kilovolts and/or three giga ohms or more.

The means for mixing 14 may be connected in fluid-flow relationship to the base of the electrostatic spray gun 12 or may be connected in fluid-flow relationship to the electrostatic spray gun 12 by a conduit at the preference of an operator. A typical example of a conduit would include part number 185-918 as available from Graco Inc. of Minneapolis, Minn.

A first conduit 16 depends from, and is connected in fluid-flow relationship to, the means for mixing 14. The first conduit 16 is preferably formed of an electrostatically isolated fluid hose, an example of which is part number 185-920 as available from Graco Inc. of Minneapolis, Minn. The first conduit 16 provides the means for conducting alternating segments of electrically less-conductive component 32 and electrically more-conductive component 36, liquid solvent, and/or air to the means for mixing 14 and ultimately to the electrostatic spray gun 12 (FIG. 3). The alternating segments of electrically less-conductive component 32 and electrically more-conductive component 36, function as a series of resistors, or alternating resistant elements, reducing the exposure of high-voltage electrical potentials generated proximal to the tip 40 of the electrostatic spray gun 12 to the upstream elements of the water-based plural component system 10.

Each segment of electrically less-conductive component 32 has an individual resistance proportional to its resistivity according to the formula $R = (P \times L) \div A$ where R = resistance, P = resistivity, L = length, and A = area. Therefore, the overall electrical resistance for the first conduit 16 may be controlled by the individual resistivity of the electrically less-conductive component 32, and the length and diameter of the isolated fluid hose, and finally by the number of individual resistive segments of electrically less-conductive component 32 located within the first conduit 16. Preferably, the combined electrical resistance of the first conduit 16 approximates three giga-ohms. Preferably, an alternating segment of electrically less-conductive component 32, and electrically more-conductive component 36, within the first conduit 16 has a combined length approximating one inch. The alternating segments of electrically more-conductive component 36 and electrically less-conductive component 32 may, however, have a combined length approximating two to four inches. Preferably the ratio of the lengths of electrically less-conductive component 32 to electrically more-conductive component 36 is 4 to 1. This ratio may vary depending on the mix ratio recommended by the fluid supplier. A ratio of less than 4 to 1 may require a longer hose, depending upon the resistivity of the electrically less-conductive component 32. The length of the first conduit 16 approximates fifteen feet. The length of the first conduit 16 may, however, be substantially longer and may approximate fifty feet at the preference of an operator. The inside diameter of the first conduit 16 is preferably one-quarter inch. The length and/or diameter of the first conduit 16 may be increased or decreased at the preference of an operator provided that the plurality of segments of electrically less-conductive component 32 within the first conduit 16 have a sufficient combined series of resistivity to prevent the grounded and/or isolated second storage facility 34, of electrically more-conductive component 36, or the electrically isolated first storage facility 30, of electrically less-conductive component 32, from shorting to ground during engagement of the water-based plural component system 10.

It should be noted that the first conduit 16 is exposed to a predetermined range of pressures for conducting the alternating segments of electrically less-conductive component 32 and electrically more-conductive component 36. The isolated fluid hose should therefore be of sufficient strength and durability to not fracture, leak, or fail during use and operation of the water-based plural component system 10 under high-pressure conditions. It should also be noted that the first conduit 16 may confine solvents which may be highly flammable, during a cleansing cycle of the water-based plurality component system 10. As such, any leakage or failure of the first conduit 16, exposing solvents to the environment proximal to an operator may be extremely dangerous during further use of an electrostatic spray gun 12.

A means for alternating 18 depends from, and is connected in fluid-flow relationship to, the first conduit 16. The means for alternating 18 is preferably a valve which regulates and alternates, the access of the electrically less-conductive component 32 and the electrically more-conductive component 36 within the first conduit 16. An example of a suitable valve is part number 220-059, identified as a color change valve, as available from Graco Inc. of Minneapolis, Minn. It should be noted that the color change valve has a maximum air inlet pressure approximating 100 psi and a maximum fluid working pressure approximating 300 psi. In the preferred embodiment, the color change valve has four valves which may be increased in number to eight at the preference of an operator. The means for alternating 18 may regulate the access to the first conduit 16 by a timing meter, or by a flow meter. If a timing cycle is used by an operator then the ratio of electrically less-conductive component 32 to electrically more-conductive component 36 is maintained approximately equal to 4 to 1. This ratio may be varied depending on the mix ratio recommended by the paint manufacturer. It should be noted that each segment of electrically less-conductive component 32 and electrically more-conductive component 36, as measured by volume or time increments, should not be so short as to cause mixing of the electrically more-conductive component 36 to the electrically less-conductive component 32 within the first conduit 16.

The means for alternating 18 is also exposed to a range of pressures during the conduction of electrically less-conductive component 32 and electrically more-conductive component 36. The means for alternating 18 is therefore of sufficient durability to withstand prolonged and repeated exposure to alternating pressures generated in the water-based plural component system 10.

A second conduit 20 depends from, and is connected in fluid-flow relationship to, the means for alternating 18. The second conduit 20 is preferably formed of an electrostatically-isolated fluid hose and preferably contains the electrically less-conductive component 32. An example of a suitable second conduit 20 is part number 185-920 as available from Graco Inc. of Minneapolis, Minn. The second conduit 20 provides the means for conducting the electrically less-conductive component 32, liquid solvent, and/or air to the means for alternating 18. The length and diameter dimensions for the second conduit 20 may be of any size at the preference of an operator. The second conduit 20 is preferably electrically-isolated and/or grounded from the third conduit 22.

Voltage in excess of the combined resistance occurring within the first conduit 16 may be exposed to the second conduit 20. The second conduit 20 is the initial segment of the electrically-isolated, electrically less-conductive component fluid-flow course, which includes the first means for regulating 24, the first storage facility 30 having an electrical connection to ground 31, and the color change system 38. The length of electrically-isolated and/or grounded second conduit 20 is computed so that it has a sufficiently high electrical resistance to not short to ground when exposed to an electrical voltage flowing upstream from the means for alternating 18.

The second conduit 20 conducts the solvent and resin mixture or air of the electrically less-conductive component 32 at a predetermined range of pressure for movement to the means for alternating 18.

The second conduit 20 is preferably connected in fluid-flow relationship to a conventional pressurized paint source identified as the first storage facility 30.

A third conduit 22 depends from, and is connected in fluid-flow relationship to, the means for alternating 18. The third conduit 22 is preferably formed of an electrostatically-isolated fluid hose and preferably confines the electrically more-conductive component 36. An example of a suitable second conduit 20 is part number 185-920 as available from Graco Inc. of Minneapolis, Minn. The length and diameter dimensions of the third conduit 22 may be of any size at the preference of an operator. The third conduit 22 is preferably electrically-isolated and/or grounded from the second conduit 20.

Voltage in excess of the combined resistance occurring within the first conduit 16 may be exposed to the third conduit 22. Excess voltage exposed to the third conduit 22 is preferably minimized by the voltage gradient drop caused by the series of alternating resistive segments of electrically less-conductive component 32 which are located downstream of the means for alternating 18. The third conduit 22 is the initial segment of the electrically isolated, electrically more-conductive component fluid-flow course, which includes the second means for regulating 26, and the second storage facility 34 having an electrical connection to ground 35 which may include a bleed-resistive element. The length of the electrically-isolated and/or grounded third conduit 22 is computed so that it has a sufficiently high electrical resistance to not short to ground when exposed to electrical voltage flowing upstream from the means for alternating 18. The third conduit 22 conducts the water and/or water-based paint of the electrically more-conductive component 36 at a predetermined range of pressures to the means for alternating 18. The third conduit 22 is preferably connected in fluid-flow relationship to a conventional pressurized water source and/or water-based paint source identified as the second storage facility 34.

Figure 2:
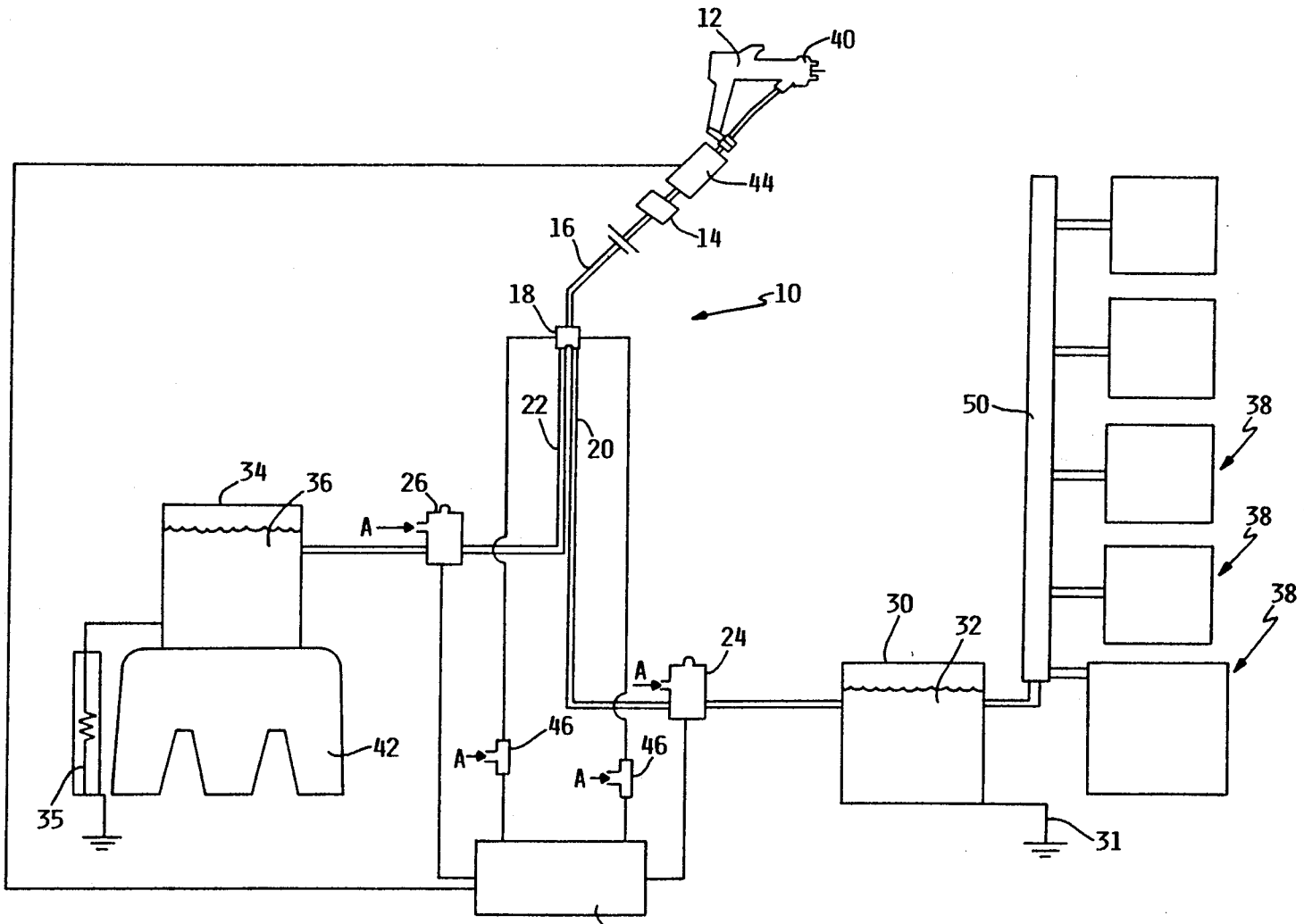
FIG. 2 is a schematic block diagram of the invention including an isolation stand.

The first means for regulating 24 is connected in fluidflow relation to the second conduit 20. The first means for regulating 24 may include a precision pulse volumetric flow fluid meter as manufactured by Graco Inc. of Minneapolis, Minn., part number 235-588. The first means for regulating 24 measures the volume of the electrically less-conductive component 32, and includes at least one valve which may be operated by a solenoid electro-mechanical mechanism as known in the art. It should be noted that the precision pulse volumetric fluid-flow meter has a maximum fluid working pressure of between 2000 and 3000 pounds per square inch. It should also be noted that the use of an isolation stand 42, as seen in FIG. 2, necessitates the use of a precision pulse volumetric fluid-flow meter part number 224-124, as available from Graco Inc. of Minneapolis, Minn., which includes fiber-optic signaling cables which are required, due to the electrical isolation of the electrically more-conductive component fluid-flow course. Alternatively, the first means for regulating 24 may include a timing meter and/or air valves at the preference of an operator. Preferably, the first means for regulating 24 is of the positive displacement volumetric type including intermeshing rotors which have angular velocity responsive means for calculation of the flow rate of electrically less-conductive component 32.

The precision pulse fluid-flow meter of the first means for regulating 24 is in fluid-flow communication with the first storage facility 30 and color change system 38 for measurement of the flow rate of the electrically less-conductive component 32 from the color change system 38 to the tip 40 of the electrostatic spray gun 12. The first means for regulating 24 responds to changes of pressure within the second conduit 20 and accordingly adjusts the flow rate of the electrically less-conductive component 32 for engagement to the means for alternating 18.

The precision pulse fluid-flow meter of the first means for regulating 24 may experience or be exposed to voltage during a painting phase and must thereby be able to produce a signal that is usable despite the presence of upstream voltage within the water-based plural component system 10. The precision pulse fluid-flow meter of the first means for regulating 24 may therefore include a mechanical structure to produce a signal at a frequency which varies with the flow rate by the means of an appropriate transducer. The transducer may be of a variable reluctance type for isolation and conversion of the signal-to-light pulses for transmission by fiber-optic means (FIG. 2).

The first means for regulating 24 is inserted in fluid-flow relationship to the second conduit 20 between the outlet for the first storage facility 30 and the means for alternating 18. The compressed air of the water-based plural component system 10 supplies the energy to move the electrically less-conductive component 32 from the color change system 38 to the first storage facility 30 and then ultimately to the tip 40 of the electrostatic spray gun 12.

It is desirable to monitor the flow rate of electrically less-conductive component 32 for the purpose of regulating a constant flow rate to the means for alternating 18. The first means for regulating 24 may alternatively include a regulator valve disposed in fluid-flow relation to the second conduit 20 between the precision pulse fluid-flow meter and a discharge port. A feedback contact may communicate with the means for control 28 for sending a signal in response to the optical signal transmitted from an optical sensor to automatically adjust the flow rate. The means for control 28 upon receipt of the optical signal from the optical sensor may automatically compute the electrically less-conductive component 32 flow rate from the frequency of the optical signals, communicated via the signal feedback contact, to automatically adjust the flow rate of the fluid through the second conduit 20, and to deliver a uniform flow rate to the means for alternating 18.

The second means for regulating 26 is connected in fluid-flow relation to the third conduit 22. The second means for regulating 26 may include a precision-pulse volumetric fluid-flow meter as manufactured by Graco Inc. of Minneapolis, Minn., part number 235-588. The second means for regulating 26 measures the volume of the electrically more-conductive component 36, and includes at least one valve, which may be operated by a solenoid electro-mechanical mechanism as known in the art. It should be noted that the precision pulse volumetric fluid-flow meter has a maximum fluid working pressure of between 2,000 and 3,000 psi. It should also be noted that the use of an isolation stand 42, as seen in FIG. 2, necessitates the use of a precision pulse volumetric fluid-flow meter, part number 224-124, as available from Graco Inc. of Minneapolis, Minn., which includes fiber-optic cables which are required, due to the electrical isolation of the electrically more-conductive component fluid-flow course. Alternatively, the second means for regulating 26 may include a timing meter and/or air valves at the preference of an operator. The second means for regulating 26 may be of the positive displacement volumetric type including intermeshing rotors which have angular velocity responsive means for calculation of the flow of electrically more-conductive component 36 through the third conduit 22.

The second means for regulating 26 responds to changes of pressure within the third conduit 22 and accordingly adjusts the flow rate of the electrically more-conductive component 36 for engagement to the means for alternating 18.

The precision pulse fluid-flow meter of the second means for regulating 26 may experience, or be exposed to voltage during a spraying phase and must therefore be able to produce a signal that is usable despite the presence of upstream voltage. The precision plus fluid-flow meter of the second means for regulating 26 may therefore include a mechanical structure to produce a signal at a frequency which varies with the flow rate by the means of an appropriate transducer. The transducer may then be of a variable reluctance type for isolation and conversion of the signal-to-light pulses for transmission by fiber-optic cable. The second means for regulating 26 is inserted in fluid-flow relationship to the third conduit 22 between the outlet for the second storage facility 34 and the means for alternating 18. The compressed air of the water-based plural component system 10 supplies the energy to move the electrically more-conductive component 36 from the second storage facility 34 to the tip 40 of the electrostatic spray gun 12.

It is desirable to monitor the flow rate of electrically more-conductive component 36 for the purpose of regulating a constant flow rate to the means for alternating 18. The second means for regulating 26 may alternatively include a regulator valve disposed in fluid-flow relationship to the third conduit 22 between the precision pulse fluid-flow meter and a discharge port. A feedback contact may communicate with the means for control 28 for sending a signal in response to the optical signal transmitted from an optical sensor, to automatically adjust the flow rate through the second means for regulating 26. The means for control 28 upon receipt of the optical signal from the optical sensor automatically computes the electrically more-conductive component 36 flow rate from the frequency of the optical signals. The optical signals are communicated via the signal feedback contact of the second means for regulating 26, to automatically adjust the flow rate in order to deliver a uniform flow rate of electrically more-conductive component 36 to the means for alternating 18.

The means for control 28 is electrically and/or optically connected to the first means for regulating 24 and to the second means for regulating 26. The means for control 28 may be a precision mix control for volumetric measurement as manufactured by Graco Inc. of Minneapolis, Minn., part number 684-005. Alternatively, the means for control 28 may be based upon volumetric or time measurement at the preference of operator.

The means for control 28 is preferably connected to the first means for regulating 24 and second means for regulating 26 by fiber-optic cables and electrical connections as is known in the art (FIG. 2). The means for control 28 may be connected to the first and second means for regulating 24, 26 by electrical connections as known, if an isolation stand 42 is not used (FIG. 1). The means for control 28 may additionally include switching valves 46 for operation of the means for alternating 18. A typical example of a switching valve 46 is a precision mix solenoid enclosure, part number 948-819, Series A, as available from Graco Inc. of Minneapolis, Minn., for use in a precision mix plural component mixing system. A precision mix solenoid enclosure operates under a 100 psi maximum air inlet pressure which is indicated by the letter identifier "A" and arrow as used in conjunction with the switching valves 46 of FIGS. 1 and 2. It should also be noted that the letter identifier "A" and arrow as used in conjunction with the first and second means for regulating 24, 26 indicates an air inlet port which may be used as the means for the supply of power for operation of the valves within the first and second means for regulating 24, 26. Generally, the solenoid enclosure receives an electrical signal from the means for control 28. An appropriate signal is then given to open and close the solenoid valves. These valves activate the functions for the means for alternating 18, which may include the regulation of access of electrically more-conductive component 36, electrically less-conductive component 32, air purge, or solvent purge to the first conduit 16.

Alternatively, the means for control 28 may include two precision pulse display PPD 200 remote units, part number 235-611, as available from Graco Inc. of Minneapolis, Minn. A precision pulse display PPD 200 remote unit is then preferably individually electrically connected to the first means for regulating 24 and the second means for regulating 26. The use of a PPD 200 remote unit allows a host computer to read and reset counters, read and write presets, inhibit and enable counts, turn outputs on and off, lock and unlock keyboards, and read and program all setup parameters. The use of a computer in this context allows for the bi-directional communications and the addressing of multiple controls on a single two-wire communication bus.

The pneumatic pressure for the water-based plural component system 10 is transmitted from the first storage facility 30 and second storage facility 34 to the means for alternating 18, via the second conduit 20 and third conduit 22. The means for control 38 responds to changes of pneumatic pressure as indicated by the sensor contacts and accordingly signals the first means for regulating 24 and second means for regulating 26 in order to adjust the flow rate of solvent and resin mixture and/or air within the second conduit 20 and the water-based paint and/or water in the third conduit 22. Alternatively, if a timing sequence is used, the means for control 28 alternatively signals the first means for regulating 24 and second means for regulating 26 following the expiration of an established sequence of counts. An example of a typical sequence would include the opening of the first means for regulating 24 for 120 counts, shutting the first means for regulating 24, opening the second means for regulating 26 for an additional 30 counts, shutting the second means for regulating 26, then repeating the cycle. It should be noted that a timing sequence may be adjusted to satisfy the particular needs of an operator.

The means for control 28 precisely activates the first means for regulating 24 and second means for regulating 26 in order to facilitate the provision of water-based paint for application to manufactured articles. The means for control 28 may include many sensitive electronic devices which require a location electrically isolated from the high-voltage electrical potentials generated at the tip 40 of the electrostatic spray gun 12. The means for control 28 may also include optical sensing devices for reading an optical signal from the sensing contacts as transmitted by the fiber-optic cables connected to the first means for regulating 24 and the second means for regulating 26 (FIG. 2). The optical signals generated from the sensor contacts are then transmitted to the means for control 28 for adjustment of the flow rates within the second conduit 20 and third conduit 22. The generated optical signals are particularly immune to electrical fields, due to the transmission outside of the range of the electrical field created by the electrostatic charging of the tip 40 of the electrostatic spray gun 12. The optical signals generated by the sensor contacts are thereby substantially unaffected by the electrostatic field from a electrostatic spray gun 12. In this manner, sensitive electronic devices or electrical currents of any kind are not positioned proximal to the location of the first means for regulating 24 or second means for regulating 26, whereby undesirable effects would be created to yield erroneous flow rate readings.

A computer may be electrically connected to the means for control 28. The means for control 28, including connected computers, may be programmed to control the operating sequence and open times for the first means for regulating 24 and second means for regulating 26. The computer upon the receipt of data concerning the mixing ratio of the electrically less-conductive component 32 and electrically more-conductive component 36 may incrementally change the proportions of the two components to provide a desired viscosity for a water-based paint to be ejected from an electrostatic spray gun 12.

The first storage facility 30 is connected in fluid-flow relationship to the second conduit 20 upstream of the first means for regulating 24. The first storage facility 30 preferably contains the electrically less-conductive component 32, which is either a solvent and resin mixture and/or air, which is selected from the available alternatives of the color change system 38. The electrically less-conductive component 32 is preferably petroleum based when the electrically less-conductive component 32 is a resin and solvent mixture.

The first storage facility 30 contains an electrical connection to ground 31. The electrical connection to ground 31 effectively electrically isolates the electrically less-conductive component fluid-flow course grounding excess electrical voltage and/or current passing upstream from the means for alternating 18. The electrical connection to ground 31 thereby functions as an additional safety measure protecting an operator during use of the water-based plural component system 10.

The first storage facility 30 is also substantially sealed and pressurized so that the electrically less-conductive component 32 may be propelled through the second conduit 20 during an engagement or painting/spraying phase of water-based paint. The first storage facility 30 is connected to a feed and pressurization unit (not shown) to deliver pressurized compressed air, and/or air, or a rinsing product from a circuit. The compressed air functions both to pressurize the first storage facility 30 and to dry the second conduit 20 during a cleaning cycle of the water-based plural component system 10. The first storage facility 30 is preferably connected in fluid-flow relation to the color change system 38 via a manifold 50. The manifold 50, as is known in the art, provides the mechanism, in conjunction with the color change system 38, to select alternate colors for application to manufactured articles at the preference of an operator. An example of a color change system may be part number 220-060, as available from Graco Inc. of Minneapolis, Minn. An alternative color change system may include part number 223-859, as available from Graco Inc. of Minneapolis, Minn. This color change system manifold has a maximum fluid working pressure of 1,500 psi and a maximum air input pressure of 100 psi. This standard Graco precision mix can regulate all popular two-component epoxy, water-based, or polyurethane paints. The precision mix is not for use with "quick-setting" paints having a pot life of less than fifteen minutes. The water-based plural component system 10 may then be set up to regulate components supplied from pressure vessels, or from feed pumps transferring the materials from their original containers, or from a central paint recirculating line. The standard unit is designed to operate an air spray or air-assisted airless system with a capacity of up to 2,000 cubic centimeters per minute.

The second storage facility 34 is connected in fluid-flow relationship to, the third conduit 22 upstream of the second means for regulating 26. The second storage facility 34 preferably contains the electrically more-conductive component 36 which is either water or water-based paint. The second storage facility 34 contains an electrical connection to ground 35. The second storage facility 34 may additionally be mounted upon an isolation stand 42. The electrical connection to ground 35 preferably contains a bleed-resistive element when used in conjunction with an isolation stand 42. The electrically more-conductive component fluid-flow course including the third conduit 22, the second means for regulating 26, and the second storage facility 34 is electrically isolated from the electrically less-conductive component fluid-flow course. The second storage facility 34, when mounted upon the isolation stand 42, is additionally effectively electrically isolated from ground. The isolation stand 42 in conjunction with the electrical connection to ground 35 thereby functions as an additional safety measure protecting an operator during use of the water-based plural component system 10. The electrical connection to ground 35 and isolation stand 42 function to electrically isolate and separate the second storage facility 34, in order to ground excess upstream voltage, thereby minimizing risks of electrical shorting, and/or risks of electrical injuries which may occur to operators through inadvertent contact with the second storage facility 34 during use of the water-based plural component system 10.

The second storage facility 34 is also substantially sealed and pressurized so that, the electrically more-conductive component 36 may be propelled through the third conduit 22 during an engagement or painting/-spraying phase of the water-based plural component system 10. As such, the second storage facility 34 may be connected to an electrically-isolated water source having a valve for filling of the second storage facility 34. The second storage facility 34 is also connected to a pressurization unit (not shown) for delivery of pressurized compressed air which functions both to pressurize the second storage facility 34 and to propel the electrically more-conductive component 36 to the means for alternating 18.

A viscometer 44 may be connected in fluid-flow relation to the first conduit 16 between the means for mixing 14 and the electrostatic spray gun 12. The viscometer 44 is preferably connected to the means for control 28 by fiber-optic cables as earlier described for the first means for regulating 24 and second means for regulating 26 (FIG. 2). The viscometer 44 provides feedback to the means for control 28 concerning the mixing ratio for the electrically more-conductive component 36 and electrically less-conductive component 32. The viscometer 44 may include a sensor powered by an air drive alternator at the preference of an operator. The viscosity of the water-based paint and/or solvent and resin mixture in many applications is critical during operation of the water-based plural component system 10. The viscosity of the water-based paint and/or solvent and resin mixture is very dependent upon the mixing ratio of the identified elements. An in-line viscometer 44 may provide the necessary feedback to the means for control 28 to incrementally adjust the mixing ratio for ultimate engagement to the means for alternating 18. Optimization of the viscosity of the water-based paint for atomization and ejection from the electrostatic spray gun 12 is therefore possible through use of a viscometer 44.

The color change system 38 is connected in fluid-flow relation to the first storage facility 30 via a manifold 50 and a conduit means. The color change system 38 permits an operator to select an alternate color for electrostatic application to a manufactured article. The electrically less-conductive component fluid-flow course is required to be thoroughly flushed and/or cleansed prior to the introduction of a different color in the system. Therefore, the color change system 38 generally includes a means for flushing which may include a supply of, and the use of, solvents and/or pressurized air and/or water. A supply of compressed or pressurized air is frequently required for introduction into the color change system 38 to propel solvent, water, and/or air downstream through the first storage facility 30, second conduit 20, first means for regulating 24, means for alternating 18, first conduit 16, means for mixing 14, and electrostatic spray gun 12. In this manner, the electrically less-conductive component fluid-flow course may be completely cleansed and/or flushed during a color change cycle to insure contaminant-free water-based painting. It should be noted that all of the solvent and resin sources, including the water source, and the color selection manifold 50 are preferably at ground potential thereby minimizing risk of electrical shorting of equipment and/or injuries to operators.

During operation, the high-tension voltage for the water-based plural component system 10 is reduced to zero for implementation of a color change via the color change system 38. When the electrostatic spray gun 12 is triggered, the electrically less-conductive component 32 enters the color change system 38 through separate paint lines and check valves, which are precisely monitored by flow meters. During engagement of the electrostatic spray gun 12 the electrically less-conductive component 32 is introduced into an integrator chamber. Entry into the chamber is controlled by a dispense valve. The flow meters monitor the exact quantities being dispensed, and send electrical pulses for the control of the electrically less-conductive component 32 through the color change system 38. A controller for the color change system 38 monitors these pulses and turns the dispense valves on or off accordingly, based upon the target volumes for the electrically less-conductive component 32 calculated by the controller.

The solvent and resin mixture of the electrically less-conductive component 32, upon selection, is propelled downstream toward the means for alternating 18 by compressed air. Following separation into segments, and mixing, the water-based paint is exposed to high-tension voltage established at the tip 40 of the electrostatic spray gun 12, whereupon painting of an object may initiate. The flow rate for the electrically less-conductive component 32 is monitored at all times and regulated by the first means for regulating 24 in conjunction with the means for control 28.

During operation, in the event that either the second conduit 20 or third conduit 22 develops a rupture or pin-hole leak the escaping paint will immediately come into contact with the grounded electrically less-conductive component fluid-flow course or electrically more-conductive component fluid-flow course. As a consequence, the operator is protected from risk of shock.

When the water-based paint flowing downstream from the means for mixing 14 is charged with an electrostatic spray gun 12, the two paths to ground defined by the electrically less-conductive component fluid-flow course and the electrically more-conductive component fluid-flow course are isolated with an isolation stand in the case of water or water-based paint and the resistance in the fluid hose in the case of the solvent and resin solution mixture. An advantage of this type of water-based plural component system 10 is that the grounded solvent and resin mixture of the electrically less-conductive component fluid-flow course may use standard color changing techniques. The electrically-isolated water supply may be common to all materials. In the past, the entire supply of water and/or paint was mixed and isolated, or alternatively, the individual reservoirs of materials were isolated. During electrostatic painting, the use of both of these methods inhibited the ability to quickly change the color of the water-based paint.

During operation, the series of resistive elements of electrically less-conductive component 32 within the first conduit 16 additively provide sufficient electrical resistance to maintain a voltage gradient drop from the tip 40 of the electrostatic spray gun 12 to the means for alternating 18. When the column of fluid within the first conduit 16 is segmented and alternated, the series of resistive elements function as a series of resistors to provide the voltage gradient drop. During use of the water-based plural component system 10, a single source of fluid, or a portion of fluid, does not require electrical isolation. The water-based plural component system 10 operates pursuant to the basic resistor concepts according to an additive series of resistors or resistive elements. The large amount of stored energy within the first conduit 16, second conduit 20, and third conduit 22 may then be dissipated by the large capacitance established by the alternating segments of electrically less-conductive component 32 and electrically more-conductive component 36.

One of the many advantages of the water-based plural component system 10 is the removal of water from a position upstream, proximal to a color change system 38, for repositioning downstream, in conjunction with electrical isolation, which enables the water-based plural component system 10 to employ standard color changing techniques.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed is:

1. A water-based plural component system comprising:

a. an electrostatic spray gun having an electrically-charged tip for dispensing a homogeneous mixture of an electrically more-conductive component and an electrically less-conductive component;

b. a means for mixing said electrically more-conductive component and said electrically less-conductive component, said means for mixing being in fluid-flow relation to said electrostatic spray gun;

c. a first conduit connected in fluid-flow relation to said means for mixing, said first conduit confining alternating portions of said electrically more-conductive component and said electrically less-conductive component;

d. a means for alternating portions of said electrically more-conductive component and said electrically less-conductive component connected in fluid-flow relation to said first conduit;

e. a second conduit connected in fluid-flow relation to said means for alternating, said second conduit confining said electrically less-conductive component;

f. a third conduit connected in fluid-flow relation to said means for alternating, said third conduit confining said electrically more-conductive component;

g. a first means for regulating connected in fluid-flow relation to said second conduit;

h. a second means for regulating connected in fluid-flow relation to said third conduit;

i. a means for control connected to said first means for regulating and said second means for regulating;

j. a first storage facility having an electrical connection to ground holding said electrically less-conductive component, said first storage facility connected in fluid-flow relation to said second conduit; and k. a second storage facility having an electrical connection to ground holding said electrically more-conductive component, said second storage facility connected in fluid-flow relation to said third conduit.

2. The water-based plural component system according to claim 1, further comprising a color change system connected in fluid-flow relation to said first storage facility.

3. The water-based plural component system according to claim 1, wherein said electrically more-conductive component is water.

4. The water-based plural component system according to claim 1, wherein said electrically more-conductive component is water-based paint.

5. The water-based plural component system according to claim 1, wherein said electrically less-conductive component is a mixture of solvent and resin.

6. The water-based plural component system according to claim 1, wherein said electrically less-conductive component is air.

7. The water-based plural component system according to claim 1, wherein said first conduit comprises an electrically-isolated fluid hose.

8. The water-based plural component system according to claim 1, wherein said alternating portions of said electrically more-conductive component and said electrically less-conductive component comprises alternating more-resistive segments and less-resistive segments acting in series providing a combined electrical resistance of at least 30 kilovolts.

9. The water-based plural component system according to claim 1, wherein said means for mixing comprises a static mixing tube.

10. The water-based plural component system according to claim 1, wherein said means for mixing comprises a preorifice.

11. The water-based plural component system according to claim 1, wherein said second conduit comprises an electrically-isolated fluid hose.

12. The water-based plural component system according to claim 1, wherein said third conduit comprises an electrically-isolated fluid hose.

13. The water-based plural component system according to claim 1, wherein said first means for regulating comprises at least one solenoid valve.

14. The water-based plural component system according to claim 13, wherein said first means for regulating further comprises a meter.

15. The water-based plural component system according to claim 1, wherein said second means for regulating comprises at least one solenoid valve.

16. The water-based plural component system according to claim 15, wherein said second means for regulating further comprises a meter.

17. The water-based plural component system according to claim 1, wherein said means for control is connected to said first means for regulating and second means for regulating by a fiber-optic cable.

18. The water-based plural component system according to claim 1, wherein said means for control is connected to said first means for regulating and said second means for regulating by an air pilot.

19. The water-based plural component system according to claim 1, wherein said means for control regulates said portions of said electrically more-conductive component and said electrically less-conductive component by volume measurement.

20. The water-based plural component system according to claim 1, wherein said means for control regulates said portions of said electrically more-conductive component and said electrically less-conductive component by time measurement.

21. The water-based plural component system according to claim 1, wherein a viscometer is connected in fluid-flow relation to a conduit between said means for mixing and said electrostatic spray gun.

22. The water-based plural component system according to claim 21, wherein said viscometer is connected to said means for control.

23. The water-based plural component system according to claim 22, wherein said viscometer is connected to said means for control by at least one fiber-optic cable for providing feedback on a mixing ratio for said electrically more-conductive component and said electrically less-conductive component.

24. The water-based plural component system according to claim 21, wherein said viscometer further comprises a sensor and is powered by an air-drive alternator.

25. The water-based plural component system according to claim 1, wherein said first means for regulating comprises a pro-pulse fluid meter having at least one solenoid valve.

26. The water-based plural component system according to claim 1, wherein said second means for regulating comprises a pro-pulse fluid meter having at least one solenoid valve.

27. The water-based plural component system according to claim 1, wherein said second storage facility is electrically isolated from ground by mounting upon an isolation stand.

28. The water-based plural component system according to claim 27, wherein said electrical connection to ground for said second storage facility further comprises a bleed-resistant element.

29. The water-based plural component system according to claim 1, wherein said third conduit is electrically isolated from said second conduit.

30. The water-based plural component system according to claim 1, wherein said second conduit is grounded.

31. The water-based plural component system according to claim 8, wherein each of said segment of said electrically less-conductive component has a length at least two and one-half times as long as said segment of electrically more-conductive component.

32. The water-based plural component system according to claim 31, wherein each segment of electrically more-conductive component has a length of at least one-eighth of an inch.

33. The water-based plural component system according to claim 1, wherein said first conduit has a length of at least of 50 feet.

34. The water-based plural component system according to claim 1, wherein said means for mixing is positioned proximal, and connected to said electrostatic spray gun by a fluid hose.

35. A water-based plural component system comprising:

a. an electrostatic spray gun having an electrically charged tip for dispensing a homogeneous mixture of an electrically more-conductive component and an electrically less-conductive component;

b. a means for mixing said electrically more-conductive component and said electrically less-conductive component, said means for mixing connected in fluid-flow relation to a first fluid hose which in turn is connected in fluid-flow relation to said electrostatic spray gun, said means for mixing being positioned proximal to said electrostatic spray gun;

c. a first conduit connected in fluid-flow relation to said means for mixing, said first conduit confining alternating portions of said electrically more-conductive component and said electrically less-conductive component where said electrically more-conductive component and said electrically less-conductive component comprises alternating more-resistive segments and less-resistive segments acting in series to provide a combined electrical resistance of at least 30 kilovolts, each of said alternating portions of said electrically less-conductive component having a length at least two and one-half times longer than the length of said electrically more-conductive component, said first conduit having a length of at least 20 feet;

d. a means for alternating portions of said electrically more-conductive component and said electrically less-conductive component connected in fluid-flow relation to said first conduit;

e. a second conduit connected in fluid-flow relation to said means for alternating, said second conduit confining said electrically less-conductive component;

f. a third conduit connected in fluid-flow relation to said means for alternating, said third conduit confining said electrically more-conductive component, said third conduit being electrically isolated from said second conduit;

g. a first means for regulating connected in fluid-flow relation to said second conduit, said first means for regulating having a pro-pulse meter and at least one solenoid valve;

h. a second means for regulating connected in fluid-flow relation to said third conduit, said second means for regulating having a pro-pulse meter and at least one solenoid valve;

i. a means for control connected to said first means for regulating and said second means for regulating wherein said means for control regulates said portions of said electrically more-conductive component and said electrically less-conductive component by time or volume measurement;

j. a first storage facility having an electrical connection to ground holding said electrically less-conductive component, said first storage facility connected in fluid-flow relation to said second conduit;

k. a second storage facility having an electrical connection to ground holding said electrically more-conductive component, said second storage facility connected in fluid-flow relation to said third conduit; and l. a color change system connected in fluid-flow relation to said first storage facility.

36. The water-based plural component system according to claim 35, wherein said electrically more-conductive component is water.

37. The water-based plural component system according to claim 35, wherein said electrically less-conductive component is a mixture of solvent and resin.

38. The water-based plural component system according to claim 35, wherein said means for mixing comprises a static mixing tube.

39. The water-based plural component system according to claim 35, wherein said means for mixing comprises a preorifice.

40. The water-based plural component system according to claim 35, wherein said means for control is connected to said first means for regulating and second means for regulating by fiber-optic cables.

41. The water-based plural component system according to claim 35, wherein a viscometer is connected in fluid-flow relation to said first fluid hose between said means for mixing and said electrostatic spray gun.

42. The water-based plural component system according to claim 41, wherein said viscometer is connected to said means for control.

43. The water-based plural component system according to claim 42, wherein said viscometer is connected to said means for control by at least one fiber-optic cable for providing feedback on a mixing ratio for said electrically more-conductive component and said electrically less-conductive component.

44. The water-based plural component system according to claim 41, wherein said viscometer further comprises a sensor and is powered by an air-drive alternator.

45. The water-based plural component system according to claim 35, wherein said electrical connection to ground for said second storage facility further comprises a bleed-resistive element.

46. The water-based plural component system according to claim 35, wherein said second conduit is grounded.

47. A method for electrostatically spraying water-based paint comprising:

a. separating said water-based paint into an electrically less-conductive component and an electrically more-conductive component upstream of an electrostatic spray gun of an electrostatic paint spraying system;

b. storing said electrically less-conductive component in an electrically-grounded first storage facility connected in fluid-flow relation to a color change system and to a first conduit;

c. storing said electrically more-conductive component in an electrically-grounded second storage facility connected in fluid-flow relation to a second conduit;

d. regulating the passage of said electrically less-conductive component in said first conduit by a first means for regulating;

e. regulating the passage of said electrically more-conductive component in said second conduit by a second means for regulating;

f. alternating portions of said regulated electrically less-conductive component and said electrically more-conductive component into alternating segments within a third conduit;

g. mixing said alternating segments of said electrically less-conductive component and said electrically more-conductive component from said third conduit into a homogeneous mixture of water-based paint proximal to said electrostatic spray gun; and h. electrostatic spraying of said homogeneous mixture of said water-based paint onto an article.

48. The method according to claim 47, further comprising propelling said electrically less-conductive component from said first storage facility through said first conduit by compressed air.

49. The method according to claim 47, further comprising propelling said electrically more-conductive component from said second storage facility through said second conduit by compressed air.

50. The method according to claim 47, wherein regulating the passage of said electrically less-conductive component and said electrically more-conductive component is performed by time measurement.

51. The method according to claim 47, wherein regulating the passage of said electrically less-conductive component and said electrically more-conductive component is performed by volume measurement.

52. The method according to claim 47, wherein the regulation of said electrically less-conductive component within said first conduit by said first means for regulating, and the regulation of said electrically more-conductive component within said second conduit by said second means for regulating, is controlled by a means for control.

53. The method according to claim 52, further comprising monitoring the viscosity of the homogeneous mixture of said electrically less-conductive component and said electrically more-conductive component following mixing, and prior to spraying, by a viscometer connected to said means for control.

54. The method according to claim 53, wherein said means for control adjusts the regulation of said electrically less-conductive component and said electrically more-conductive component for the provision of a desired viscosity of said homogeneous mixture of said water-based paint.

55. The method according to claim 47, wherein said electrically more-conductive component in said second storage facility is electrically isolated from ground and is electrically isolated from said first storage facility.

56. The method according to claim 47, wherein said electrically less-conductive component is formed of a mixture of solvent and resin.

57. The method according to claim 47, wherein said electrically less-conductive component is air.

58. The method according to claim 47, wherein said electrically more-conductive component is water.

59. The method according to claim 47, wherein said electrically more-conductive component is water-based paint.

* * * * *